US006106402A

United States Patent [19]

Leonard et al.

[11] Patent Number: 6,106,402

[45] Date of Patent: Aug. 22, 2000

[54] AUTOMATIC LEVELING SYSTEM

[75] Inventors: Kenneth E. Leonard, Warren; Vernon O. Woody, Boardman, both of Ohio

[73] Assignee: Dinesol Plastics, Niles, Ohio

[21] Appl. No.: 09/130,406

[22] Filed: Aug. 6, 1998

[51] Int. Cl.[7] ..... A63G 9/16

[52] U.S. Cl. ..... 472/119; 19/450; 472/125

[58] Field of Search ..... 472/118, 119, 472/125; 29/450, 428

[56] References Cited

U.S. PATENT DOCUMENTS

| | | | |
|---|---|---|---|
| 1,066,991 | 7/1913 | Brogley . | |
| 1,548,535 | 8/1925 | Lydecker | 472/125 |
| 3,901,165 | 8/1975 | Schlesigner | 108/149 |
| 4,304,437 | 12/1981 | Longo | 297/277 |
| 5,287,610 | 2/1994 | Gomolak et al. | 29/91.1 |
| 5,573,465 | 11/1996 | Kitchen et al. | 472/118 |
| 5,580,317 | 12/1996 | Yun | 472/120 |

FOREIGN PATENT DOCUMENTS 2501517 9/1982 France .

*Primary Examiner*—Kien T. Nguyen
*Attorney, Agent, or Firm*—Robert Gilen

[57] ABSTRACT

A system for orienting or biasing swings before installation uses a device having a bed adjusted to the desired orientation or bias. The swing is supported from a temporary support by its normal semi-elastic supports which are stretched in a manner to conform to the bias of the bed. In order to obtain the necessary amount of stretching in the semi-elastic support, the swing is forced into the bed during a process in which the bed is moved vertically to facilitate the stretching of the semi-elastic supports.

15 Claims, 2 Drawing Sheets

AUTOMATIC LEVELING SYSTEM

TECHNICAL FIELD

The present invention relates generally to the construction and pre-adjustment of bodies suspended at a particular orientation on elastic or semi-elastic support structures such as rope. In particular, the present invention is directed to a system for automatically providing the correct bias for a swing seat prior to installation.

BACKGROUND ART

Elastic or semi-elastic structures, such as rope, are used to support a number of structural elements in a wide variety of uses. Some examples are swings, shelves, acrobatic devices and hanging displays. The most common device supported by rope or other elastic or semi-elastic supports are swings, particularly those dedicated for use by children. Techniques for adjusting such swings are well-known and a number of examples are provided below.

French Patent No. 2,501,517 to Hardy discloses a swing for small children having a seat which is suspended from ropes fixed at the top of the rope by jaws pulled together by a spring. An attachment ring for each rope is hung from a hook under each set of jaws. The height of the seat can be adjusted by altering the position of guides on each rope to which the respective ropes are threaded. Pre-installation adjustment is not disclosed.

U.S. Pat. No. 4,304,437 to Longo discloses adjustable chair suspended from a single support point. The chair is biased for the comfort of the user. At the top of the chair are two support members forming an "A" frame. Both are pivotally mounted to the back of the chair at either side. A rope is attached to the front of the bottom of the chair and passes over the apex of the "A" frame to support the bottom of the chair. The base of the chair can be varied by adjusting the length of the rope. Adjustment to the rope as well as any other structure that can be used to adjust the bias of the chair is made after the chair is installed.

U.S. Pat. No. 5,580,317 to Yun discloses a swing which allows the manual elevation of a user's position by use of the users feet or hands. The swing time is increased by the movement of the users hand and feet. The apparatus includes a fixed sitting board attached to the swing ropes and having an arcuate hollow guide pipe, as well as a fixed pipe. Also included is a moveable sitting board coupled to the fixed board, and having an arcuate slide bar engaged with the guide pipe of the fixed board. The moveable sitting board also has a support bar which is pivoted to the fixed pipe of the fixed board by a pivot pin. Pre-installation adjustment is apparently not disclosed.

U.S. Pat. No. 1,066,991 to Broagley discloses a baby swing having a foot-rest which assumes a position beneath the seat while the swing is unoccupied, and automatically projects into an active position when occupied. As a result, the foot-rest is eliminated as an obstruction. As a result, larger children can use the swing by temporarily discarding the foot-rest. These adjustments occur after installation.

U.S. Pat. No. 3,901,165 to Schlesinger discloses a hanging shelf with the leveling device. The shelf has a platform suspended by at least three cords or other flexible suspension structures. The upper ends of the cords are gathered in a knot formed with a loop for suspension from a hook. The lower ends of the cords are attached to the platform. Two of these cords are attached at opposite ends of the side of the platform on one side of the shelf. At the opposite end of the shelf a bead slides over two other ends of the cords to provide leveling adjustment. Other adjustments are apparently carried out after installation of the shelf.

U.S. Pat. No. 5,287,610 to Gomolak et al. discloses a seat assembly work station and a method of operating the work station. The work station is dedicated to adjusting a seating unit. A vertical compressor operates to compress a seat bottom cushion of the seating unit while at the same time permitting rotation of the compressor and the seat pedestal about a common vertical access. This facilitates final installation of the bottom cushion. Further, a second essentially horizontal compressor and a pair of manually operable seat back rest trim cover structures are provided for assisting a worker in the final assembly of the seat back rest trim to the seating unit. There is no indication that the seating unit is suspended from rope or any other semi-elastic structure, or that the back of the seat is adjusted before installation as a hanging unit.

The conventional art discloses no teaching of adjusting the ropes of the swing to a particular swing seat bias before installation of the swing. As a result, tedious adjustments are often necessary to adjust the swing to the correct bias after the swing has been installed. To obtain the correct swing bias by stretching and adjusting the ropes that suspend the swing, the final adjustments of the swing can become very problematical. Consequently, there remains a need for a quick, easy technique for pre-adjusting a swing (including rope stretching and measuring form placement in supports) before installation of the swing.

SUMMARY OF THE INVENTION

Consequently, it is one object of the present invention to properly adjust the bias of a swing or other suspended structure before installation thereof.

It is another object of the present invention to pre-stretch ropes or other semi-elastic suspension structures for a swing or other suspended structure.

It is a further object of the present invention to simplify the installation and adjustment of swings and other suspended structures.

It is yet another object of the present invention to facilitate more accurate adjustment of swings and other suspended structures.

It is again a further object of the present invention to provide a system for rapidly providing adjustments to large numbers of swings or similar structures before on-site installation of those structures.

These and other goals and objects of the present invention are provided by a method of orientating a rigid structure suspended by semi-elastic apparatus arranged to support the rigid structure. The method includes a first step of suspending the rigid structure to rest in a bed arranged at a desired orientation. Then, the rigid structure is forced into the bed to force the rigid structure to the desired orientation. Finally, the bed is moved in a vertical direction to stretch and position the semi-elastic support structures in a manner consistent with maintaining the rigid structure at the desired orientation.

Another aspect of the present invention includes a system for orienting a rigid structure suspended by a semi-elastic devices arranged to support the rigid structure. An apparatus includes a device for suspending the rigid structure to rest in a bed arranged at a desired orientation. Also included is a device for forcing the rigid structure into the bed to place the rigid structure at the desired orientation. The apparatus is also included to allow movement of the bed in a vertical direction to stretch the semi-elastic and position support structures in a manner consistent with maintaining the rigid structure at the desired orientation.

DETAILED DESCRIPTION OF THE PREFERRED EMBODIMENTS

Figure 1:
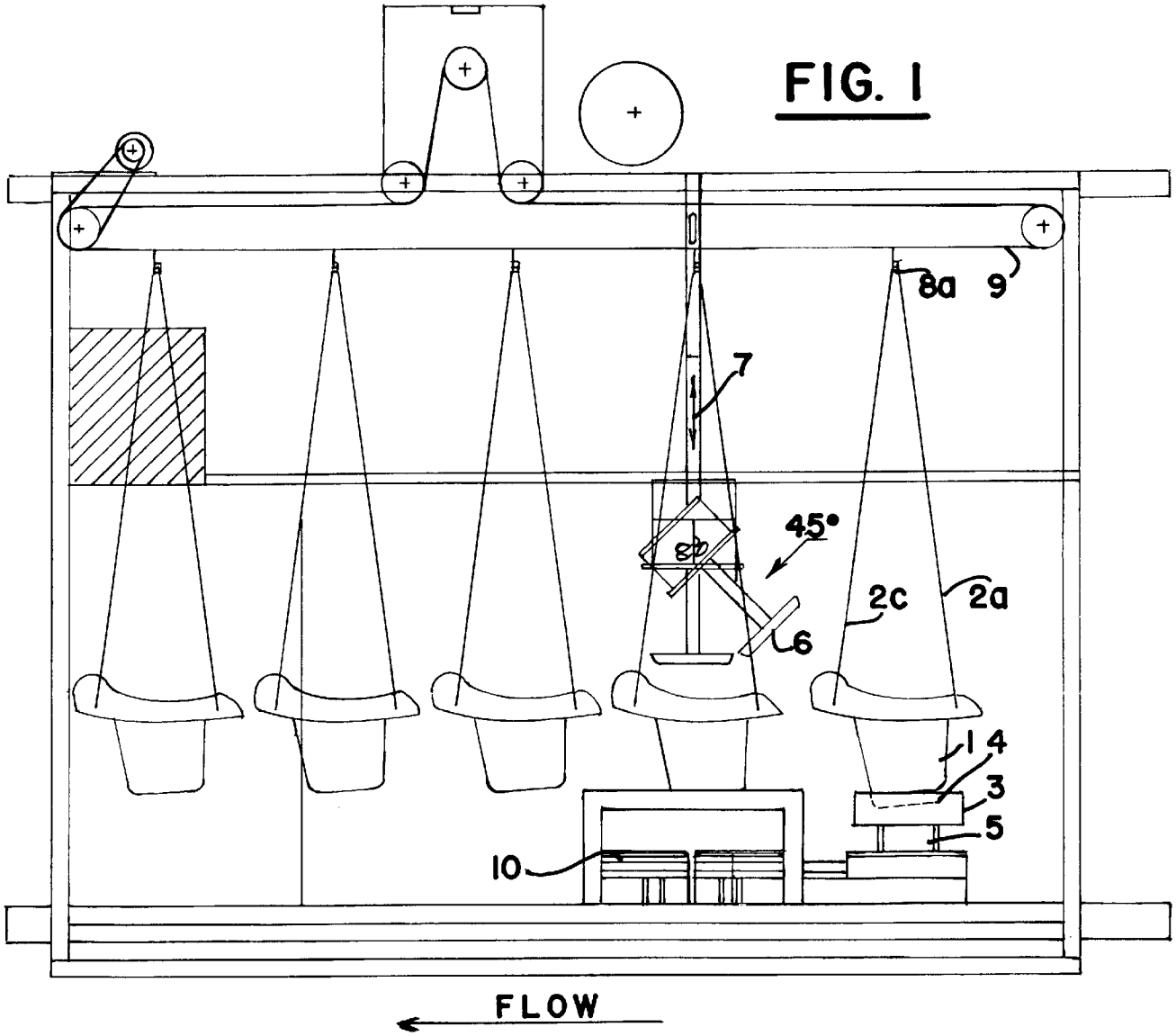
FIG. 1 is a sideview of the system of the present invention.
Figure 2:
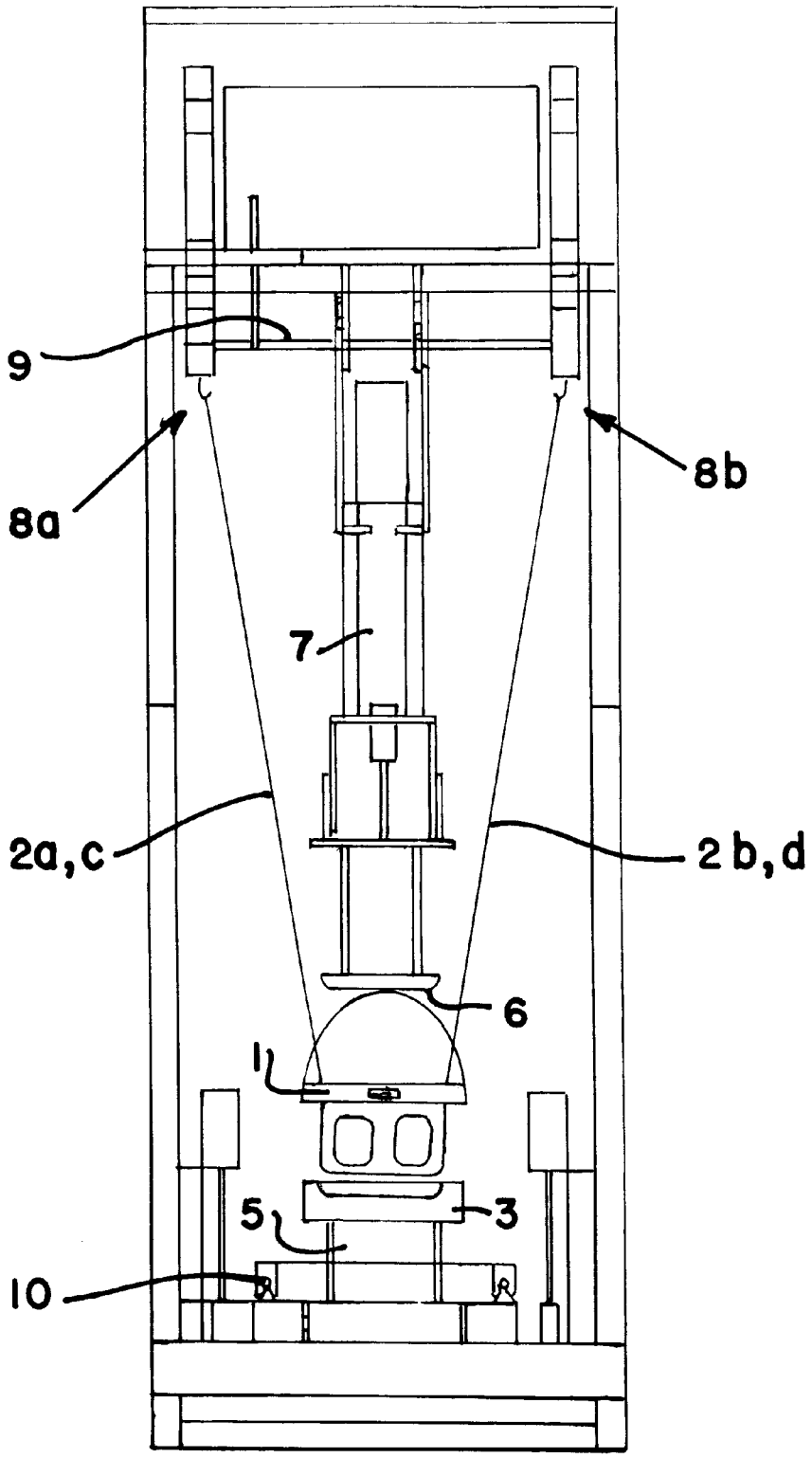
FIG. 2 is a front of the system of the present invention.

The first embodiment as depicted in FIGS. 1 and 2 is directed to the orientation of a child swing 1 prior to installing the swing in its final place of use. The swing is preferably made of some rigid material such as wood, plastic, hard rubber, fiberglass, etc., and is preferably suspended at 2 points by 2 lengths of rope (2(*a*), 2(*b*)) arranged in pairs to be supported at two support points by hooks 8(*a*), 8(*b*). However, it should be noted that the present invention can also be applied to the suspension and orientation of other rigid structures such as shelves, signs, artwork, antennas, electronic displays, acrobatic devices, etc. Further, while the first preferred embodiment is directed to the orientation of a swing suspended by ropes, other semi-elastic support means can also be used. Examples include plastic chain, leather, rubber straps and ductile metal cable.

It is noted that the rope used in the preferred embodiment be constituted in any number or configuration of natural or man-made fibers. A physical arrangement of the rope can be anything suitable from the weaving of small fibers, to a braid of a few large fibers, to a single solid strand of material. The material must be capable of bending in the middle so that two ends of each piece of the rope can be connected to two different points of the swing seat while the middle can be positioned to be connected to a support means, either permanent or temporary as shown in the adjusting device 20 of FIGS. 1 and 2. The rope must be at least semi-elastic in nature. In particular, the rope must have some elasticity but still be capable of being deformed or stretched to an extent that will allow such deformation to constitute a permanent adjustment in the orientation of the swing seat.

To carry out the method of the present invention, an operator will mount the support ropes bands 2(*a*), and 2(*b*), respectively in approximately the center of each on hooks 8(*a*), 8(*b*), respectively. These hooks are constituted as part of conveyor system 9 which is relied upon to move swing 1 from the first position on the far right hand of the machine 20, through the machine, to the end position on the far left hand side of the machine.

The first position on the machine is arranged so that bed 3 is positioned for concavity 4 to receive the bottom of the swing seat 1. The operator can manually adjust the ropes 2(*a*), and 2(*b*), respectively to conform the tilt of the swing seat 1 to conform with the bias of the concavity 4.

When the operator enters the machine 20 beneath conveyor 9 or places his or her arms therein, an OSHA-approved E-STOP system 11 would be activated to deactivate the conveyor system 9, as well as the bed positioning unit 10. Such safety systems are well-known in virtually all manufacturing systems and need no further elaboration for purposes of explaining the present invention. Once the operator has removed himself or herself from the machine and outside the conveyor system 9, the machine can be energized to move swing 1 in direction of the arrow labeled flow. This is accomplished by conveyor 9 and bed system 10 which simultaneously move the swing to a second position beneath piston cylinder 7.

Once the swing 1 and the bed 3 are in the second position beneath piston cylinder 7, the contact portion 6 swings from 45° to 0° as depicted in FIG. 1 so that the contact portion aligns with the bottom of the swing seat 1. Once the contact portion 6 is in position (0° from the axis of the piston cylinder 7), piston cylinder 7 automatically operates to push the contact portion against the bottom of swing seat 1 the piston drives the contact portion so as to force seat 1 closely into concavity 4, conforming the seat bias therewith. The force of the piston stroke moves bed 3 vertically downwards. This movement is facilitated by a flexing mechanism 5 which can be constituted by a hydraulic cylinder, spring mechanism or any other similar mechanism well-known in the technology of positioning work pieces. This operation positions the ropes 2(*a*), and 2(*b*), respectively through hooks 8(*a*) and 8(*b*) respectively. This operation also stretches the ropes thereby slightly deforming them to maintain the proper position so as to hold swing seat 1 in the proper position (that provided by concavity 4).

Once this operation has been completed the vertical cylinder 7 reverses, withdrawing the contact portion 6. Bed 3 returns to its original position by virtue of the reverse operation of flexing mechanism 5, and the elasticity of ropes 2(*a*), and 2(*b*), respectively, raise swing seat 1 from cavity 4. The conveyor system 9 operates automatically to move the swing to the next position and carry out the repeat operation with the next swing. When the swing is finally moved to the far left hand side of the machine, an operator removes the swing, and prepares it for the subsequent operation. The overall operation of the machine, including the movement of conveyor system 9 and transport 10 can be preprogrammed to be carried out automatically, stopping only when interrupted by the intervention of an operator either loading or unloading a swing.

While at least one embodiment has been presented by way of example, the present invention should not be construed to be limited thereby. Rather, the present invention should be interpreted to encompass all variations, permutations, alterations, adaptations and embodiments falling within the scope of the following claims.

We claim:

1. A method of orienting a rigid structure suspended by semi-elastic means for supporting said rigid structure, said method comprising the steps of:

(a) suspending said rigid structure to rest in a bed arranged at a desired orientation;

(b) forcing said rigid structure into said bed to place said rigid structure at said desired orientation; and, (c) moving said bed in a vertical direction to stretch and position said semi-elastic support structures in a manner consistent with maintaining said rigid structure at said desired orientation.

2. The method of claim 1, further comprising the step of:

(d) releasing said rigid structure from said bed.

3. The method of claim 2, wherein said semi-elastic means are connected at respective first ends to said rigid structure and at second respective ends to support means for providing temporary support located above said bed.

4. The method of claim 3, wherein step (a) further comprises sub-step of (i) connecting said respective second ends of said semi-elastic means to said support means for providing temporary support.

5. The method of claim 4, wherein step (a) further comprises substep of (ii) adjusting said bed to said desired orientation.

6. The method of claim 5, wherein step (c) further comprises maintaining constant force on said rigid structure into said bed.

7. The method of claim 6, further comprising the step of:

(e) moving said rigid structure away from said bed by moving said temporary support means.

8. A system for orienting a rigid structure suspended by semi-elastic means for supporting said rigid structure, said system comprising:

(a) a bed arranged to receive said rigid structure at a desired orientation;

(b) means for suspending said rigid structure to rest on said bed;

(c) means for forcing said rigid structure into said bed to place said rigid structure at said desired orientation; and, (d) means for moving said bed in a vertical direction to stretch said semi-elastic support structures in a manner consistent with maintaining said rigid structure at said desired orientation.

9. The system of claim 8, wherein said means for suspending comprise a conveyor system arranged to receive said semi-elastic means at a first end.

10. The system of claim 9, further comprising:

(e) means for moving said bed from said first position on said conveyor to a second position beneath said means for forcing.

11. The system of claim 10, wherein said rigid structure comprises a swing seat.

12. The system of claim 11, wherein said semi-elastic means comprise rope.

13. The system of claim 12, wherein said means for forcing comprise a contact portion arranged to fit into a bottom portion of said swing seat and a piston portion arranged to drive said contact portion into said swing seat.

14. The system of claim 13, wherein said contact portion is arranged to rotate between 0° and 45° with respect to said piston portion.

15. The system of claim 14, wherein said conveyor comprises means for suspending a plurality of swings.

* * * * *